US008763215B1

(12) United States Patent
Lin

(10) Patent No.: US 8,763,215 B1
(45) Date of Patent: Jul. 1, 2014

(54) STRUCTURE FOR QUICKLY CLIPPING ADVERTISING CURTAIN

(71) Applicant: Ruei-Hsing Lin, New Taipei (TW)

(72) Inventor: Ruei-Hsing Lin, New Taipei (TW)

( * ) Notice: Subject to any disclaimer, the term of this patent is extended or adjusted under 35 U.S.C. 154(b) by 0 days.

(21) Appl. No.: 13/794,825

(22) Filed: Mar. 12, 2013

(51) Int. Cl.
*A41F 1/00* (2006.01)

(52) U.S. Cl.
USPC ..... 24/516; 24/494; 24/498; 160/380; 40/790; 40/658; 40/603

(58) Field of Classification Search
USPC ..... 40/790, 658, 647, 666, 603, 604; 160/327, 380; 24/513, 516, 517, 494, 24/498
See application file for complete search history.

(56) References Cited

U.S. PATENT DOCUMENTS

| | | | | |
|---|---|---|---|---|
| 2,819,507 | A * | 1/1958 | Petersen | 24/456 |
| 3,235,928 | A * | 2/1966 | Clark | 24/517 |
| 4,557,503 | A * | 12/1985 | Linn | 281/47 |
| 5,927,671 | A * | 7/1999 | Pynenburg | 248/451 |
| 6,546,658 | B2 * | 4/2003 | Pitcher et al. | 40/658 |

* cited by examiner

*Primary Examiner* — Casandra Davis
(74) *Attorney, Agent, or Firm* — Leong C. Lei

(57) ABSTRACT

A structure for quickly clipping an advertising curtain includes a first frame, a second frame secured to the first frame so as to form a guide-groove space and a clipping space and at least a fastener arranged in the guide-groove space, wherein the fastener includes a first connecting part and a second connecting part pivoted with the first connecting part, wherein the second connecting part includes a compressible portion laterally extending from two sides thereof at an end of the second connecting part, wherein the compressible portion of the second connecting part has two ends abutting against sidewalls of the guide-groove space such that the first and second frames can be quickly assembled or disassembled due to the guide-groove space being pushed to expand.

8 Claims, 8 Drawing Sheets

STRUCTURE FOR QUICKLY CLIPPING ADVERTISING CURTAIN

BACKGROUND OF THE DISCLOSURE a) Field of the Disclosure

The invention relates to a structure for quickly clipping an advertising curtain, and more particularly, to a concept of combination of a first frame and a second frame for forming a guide-groove space and a clipping space, wherein a fastener includes a compressible portion with two ends abutting against sidewalls of the guide-groove space formed by the first and second frames such that the first and second frames can firmly join due to the guide-groove space being pushed to expand.

b) Brief Description of the Related Art

With regards to a medium or large type of advertising curtains, huge, shock and eye-catching makers in a long distance can be provided, and moreover, advertisement can be impressed particularly in a playground, in an exhibition hall, on a building curtain or on an external wall of a huge building. The advertising curtains are the enterprise and the consortium's most favorite way to advertise, and can be focused on by consumers. Currently, the medium or large type of advertising curtains have been developing well and become key business advertising practitioners focus on developing. However, referring to FIG. 1, a traditional advertising curtain is exhibited by multiple frames A composing a skeleton of required advertisement. Each of the frames A is provided with a frame groove B. An advertising curtain C is provided with eye-shaped holes, at a periphery of the advertising curtain C, tied on the frame grooves B in the frames A by ropes C1 such that the advertising curtain C can be pulled to exhibit in a flat way and can be fastened on the frames A.

With regards to the medium or large type of advertising curtains, the process to pull, expand or fasten the advertising curtain C using the ropes C1 to tie the advertising curtain C on the frame groove B in the frame A is time-consuming. The way to tie the ropes C1 is concerned with the durability of the tying between the advertising curtain C and the ropes C1. However, when the advertising curtain C is impacted by wind forces in different directions, the whole sheet of the advertising curtain C bears relatively high wind resistance. The instant reaction stress due to the shock or movement of the advertising curtain C causes the ropes C1 and the eye-shaped holes C2 at the periphery of the advertising curtain C to bear high instant stress of wind resistance. The high instant destructive tension or stress would lead the rope C1 or the eye-shaped holes C2 at the periphery of the advertising curtain C to be broken. However, the problems cannot be only solved by the tying fashion of the rope C1. Aerial works are required for follow-up maintenance. This causes the maintenance to be difficult, dangerous and cost-consuming.

In practice, the whole frames A could be bent or deformed and the medium or large type of the advertising curtain could have the skeleton to be damaged or collapsed because the advertising curtain C hardly bears the high instant destructive tension of wind resistance, that is, the wind resistance impacted on a surface of the advertising curtain C, which directly passes to the whole frames A.

SUMMARY OF THE DISCLOSURE

In accordance with the present invention, a structure for quickly clipping an advertising curtain includes a first frame, a second frame secured to the first frame so as to form a guide-groove space and a clipping space and at least a fastener arranged in the guide-groove space formed by the first and second frames, wherein the fastener includes a first connecting part and a second connecting part pivoted with the first connecting part, wherein the second connecting part includes a compressible portion laterally extending from two sides thereof at an end of the second connecting part, wherein the compressible portion of the second connecting part has two ends abutting against sidewalls of the guide-groove space formed by the first and second frames such that the first and second frames can be quickly assembled or disassembled due to the guide-groove space being pushed to expand. At the same time, the clipping space formed by the first and second frames can be reduced to firmly clip a sidebar of a predetermined object, such as a sidebar of an advertising curtain, such that the predetermined object can be prevented from dropping from the clipping space.

In accordance with the above structure for quickly clipping the advertising curtain, the combination of the first and second frames and fastener can lead the traditional medium or large type of advertising curtain not to bear point-wise wind resistance, due to the tying of the ropes C1 and the eye-shaped holes C2 at the periphery of the advertising curtain, but to bear linear or planar wind resistance. Thereby, the bearing of the stress of wind resistance can be dispersed and thus the assembly, flatness, construction efficiency, maintenance and the stress of wind resistance can be significantly improved.

The accompanying drawings are included to provide a further understanding of the invention, and are incorporated as a part of this specification. The drawings illustrate embodiments of the invention and, together with the description, serve to explain the principles of the invention.

BRIEF DESCRIPTION OF THE DRAWINGS

The drawings disclose illustrative embodiments of the present disclosure. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it refers to the same or like components or steps.

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure.

Figure 1:
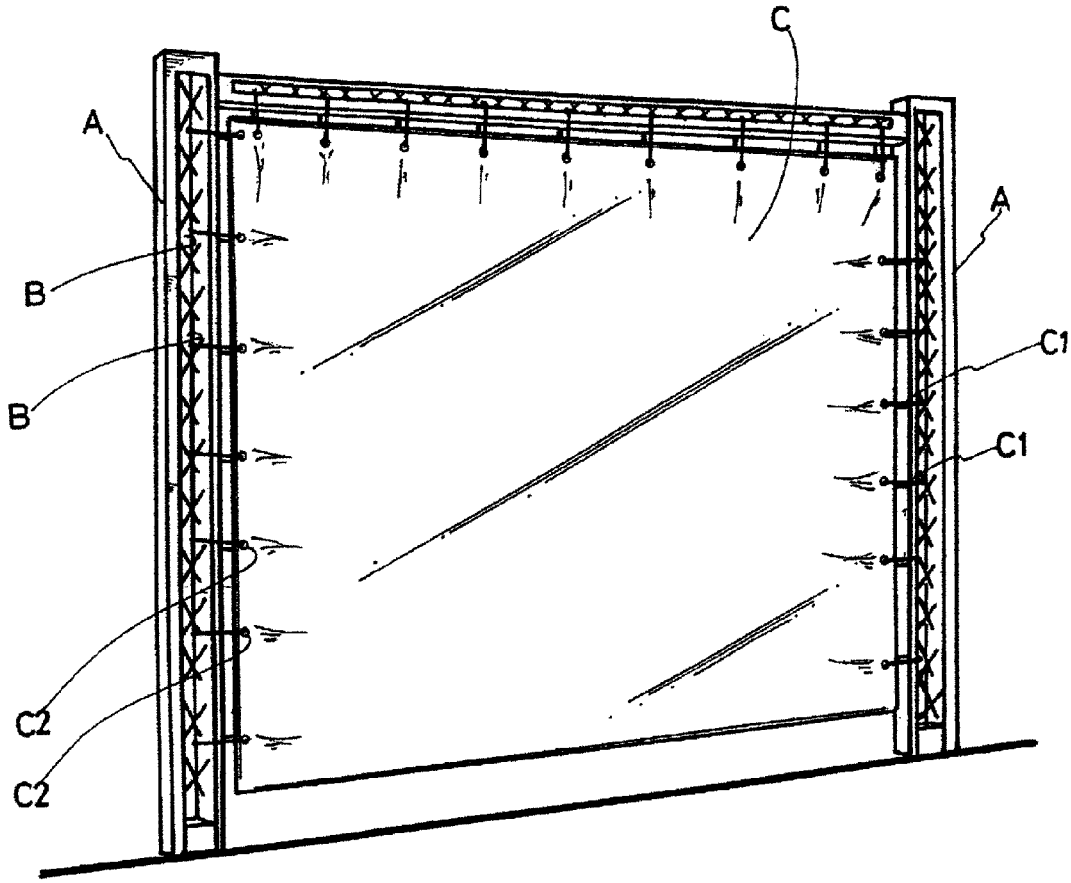
FIG.1 PRIOR ART
FIG. 1 is a schematic view of traditional frames for advertising.
Figure 2:
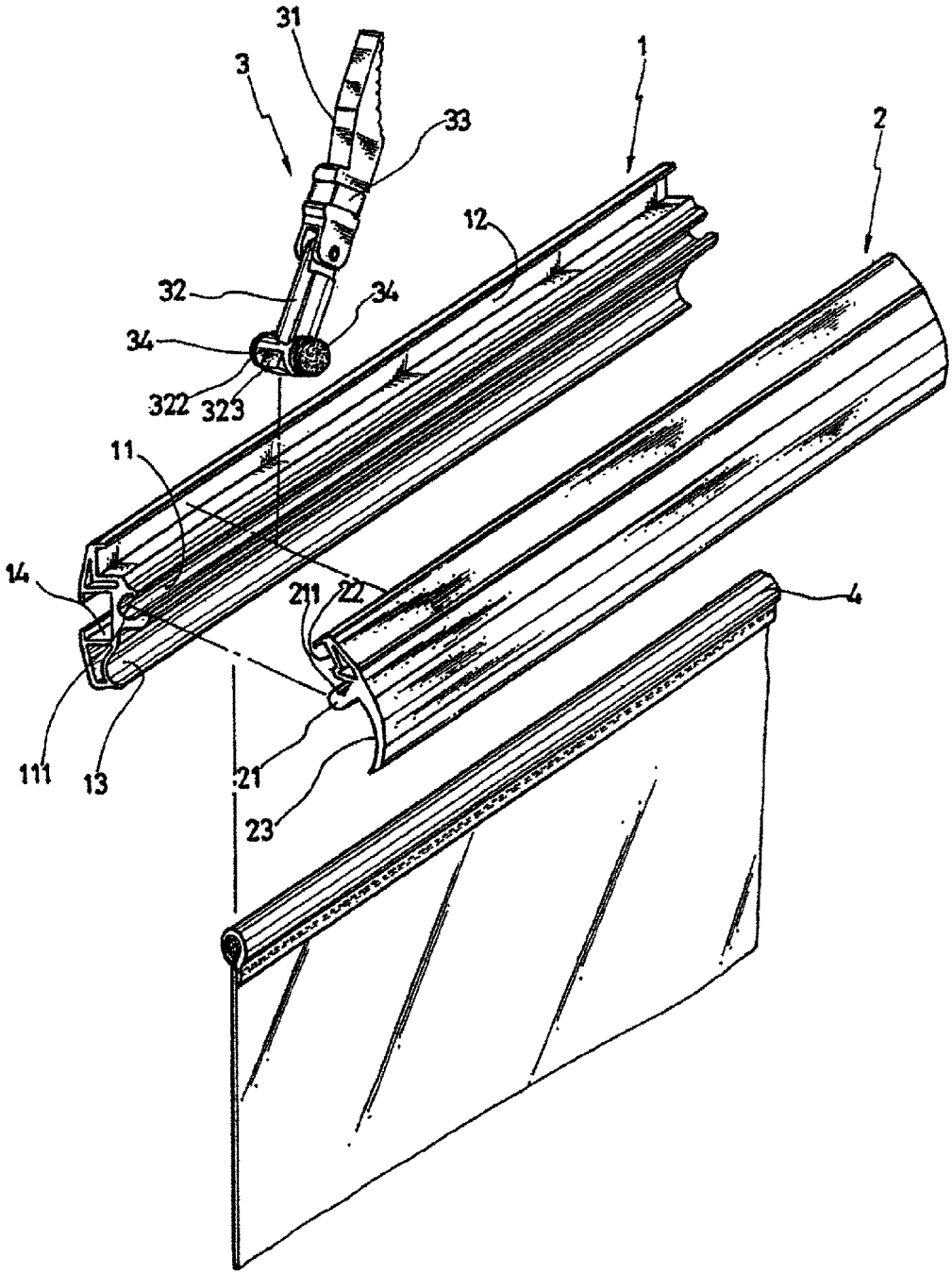
FIG. 2 is an exploded view of a structure for quickly clipping an advertising curtain in accordance with the present invention.
Figure 3:
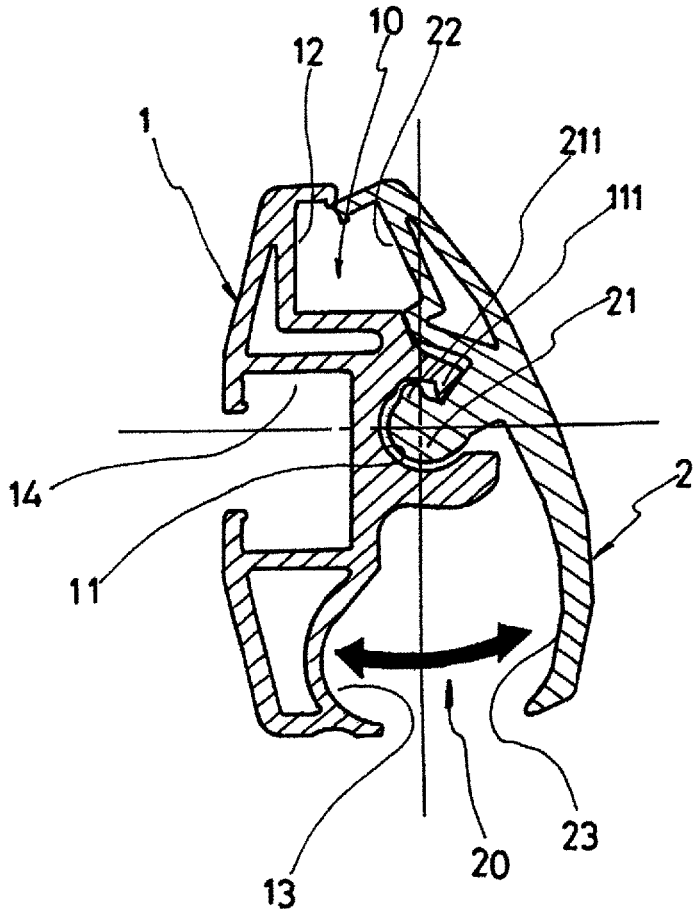
FIG. 3 is a cross-sectional side view of the structure for quickly clipping the advertising curtain in accordance with the present invention.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION OF THE INVENTION

Illustrative embodiments are now described. Other embodiments may be used in addition or instead. Details that may be apparent or unnecessary may be omitted to save space or for a more effective presentation. Conversely, some embodiments may be practiced without all of the details that are disclosed.

Referring to FIGS. 2, 3, 4 and 5, in accordance with the present invention, a structure for quickly clipping an advertising curtain includes a first frame 1, a second frame 2 and at least a fastener 3.

A joining groove 11 is arranged at a side of the first frame 1 and at least a first locking hook 111 is arranged at an open end of the joining groove 11. The first frame 1 is provided with a first guide groove 12 at a side of the joining groove 11 and a first recessed groove 13 at another side of the joining groove 11. A connecting groove 14 is arranged at another side of the first frame 1.

The second frame 2 is secured to the first frame 1. The second frame 2 includes a joining portion 21 at a side of the second frame 2, wherein the joining portion 21 is correspondent to the joining groove 11 at the first frame 1 and configured to be secured to the first frame 1. The joining portion 21 includes at least a second locking hook 211 configured to be engaged with the first locking hook 111. The second frame 2 is provided with a second guide groove 22 at a side of the joining portion 21 and a second recessed groove 23 at another side of the joining portion 21. The second guide groove 22 at the second frame 2 is correspondent to the first guide groove 12 at the first frame 1 and both form a guide-groove space 10. The second recessed groove 23 at the second frame 2 is correspondent to the first guide groove 13 at the first frame 1 and both form a clipping space 20.

The fastener 2 is embedded in the guide-groove space 10 formed by the first and second frames 1 and 2. The fastener 3 includes a first connecting part 31 and a second connecting part 32. The first connecting part 31 includes a first connecting portion 312 at an end of the first connecting part 31 and a triggering portion 313 at another end of the first connecting part 31. The first connecting part 31 is provided with a securing groove 311 between the first connecting portion 312 and the triggering portion 313. A ⊓-shaped elastic element 33 can be embedded in and fixed with the securing groove 311. The triggering portion 313 has a slopped surface 3131 facing the guide-groove space 10. The second connecting part 32 includes a second connecting portion 321 at an end of the second connecting part 32 and a compressible portion 322 laterally or horizontally extending from two sides thereof at an end of the second connecting part 32 far away from the second connecting portion 321. Thereby, the compressible portion 322 and the second connecting part 32 construct a T-shaped structure. The compressible portion 322 includes elastomer 34 at two ends of the compressible portion 322. The second connecting part 32 includes at least a bump 323 protruding from a surface of the second connecting part 32 far away from a surface of the guide-groove space 10.

The first and second connecting parts 31 and 32 of the fastener 3 can be pivoted with each other. In an embodiment, the first connection portion 312 of the first connecting part 31 can be set with a recess and first axial holes 3121. The second connection portion 321 of the second connecting part 32 can be set with a second axial hole 3211 correspondent to the first axial holes 3121. An axial rod 35 can pass through the first and second holes 3121 and 3211 such that the first and second connecting parts 31 and 32 of the fastener 3 can be pivoted with each other.

Figure 6:
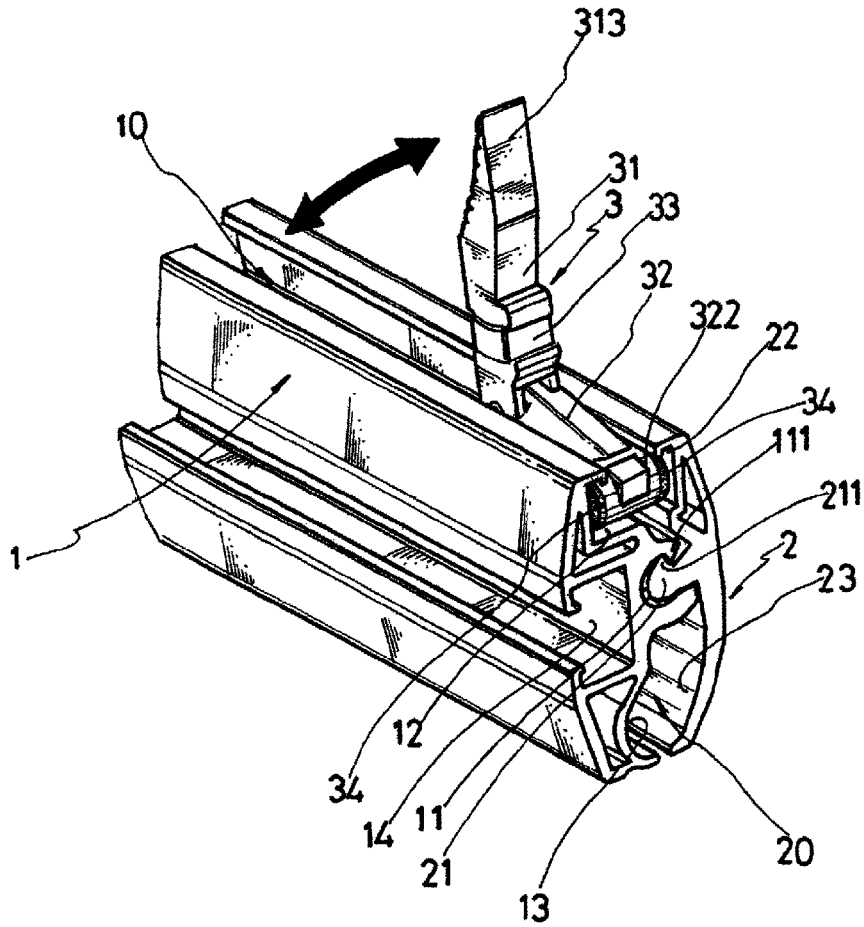
FIG. 6 is a schematic view of the structure for quickly clipping the advertising curtain operating in a first mode in accordance with the present invention.
Figure 7:
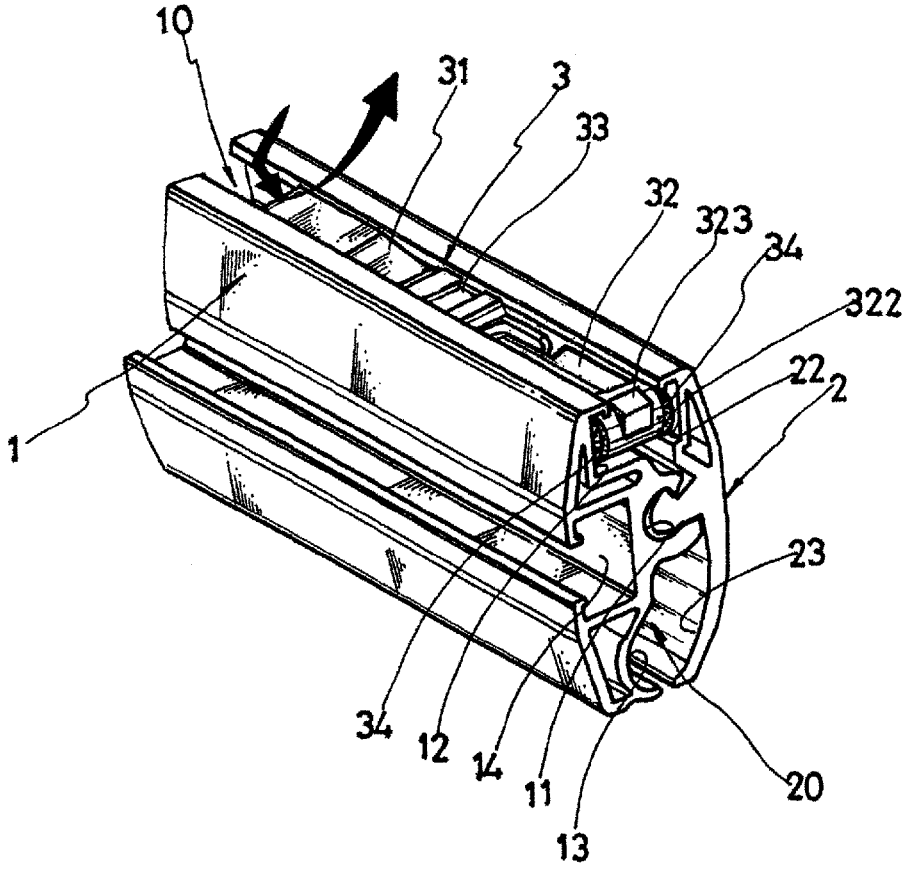
FIG. 7 is a schematic view of the structure for quickly clipping the advertising curtain operating in a second mode in accordance with the present invention.

Referring to FIGS. 6 and 7, the first frame 1 can be secured to the joining portion 21 of the second frame 2 by means of the joining groove 11. When the joining portion 21 is secured to the joining groove 11, the first locking hook 111 at the joining groove 11 can be engaged with the second locking hook 211 of the joining portion 21 and thus the joining portion 21 can be prevented from dropping from the joining groove 11. Thereby, the first frame 1 can be firmly secured to the second frame 2.

Figure 4:
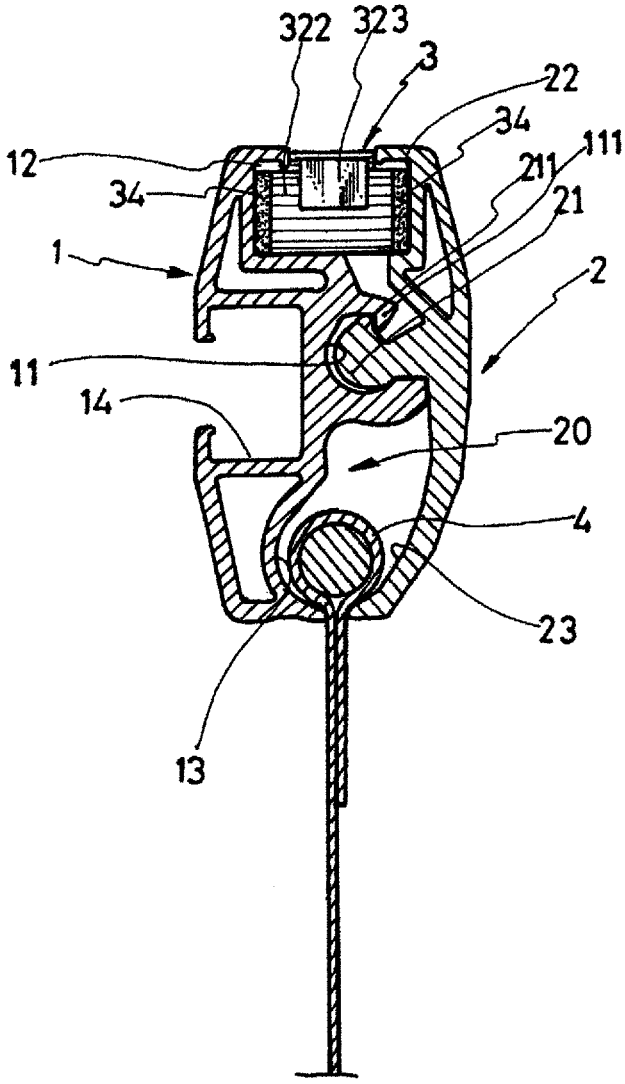
FIG. 4 is another cross-sectional side view of the structure for quickly clipping the advertising curtain in accordance with the present invention.
Figure 5:
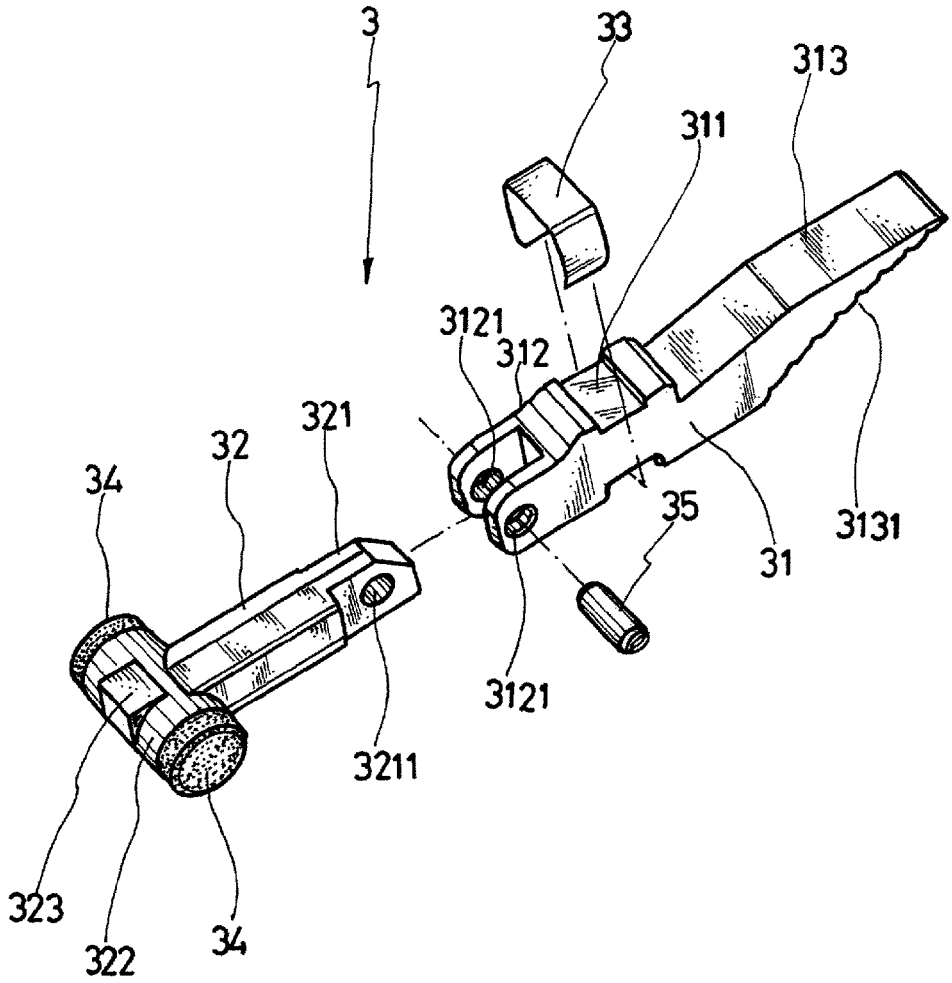
FIG. 5 is an exploded view of a fastener of the structure for quickly clipping the advertising curtain in accordance with the present invention.

Besides, the fastener 3 is secured in the guide-groove space 10 formed by the first and second frames 1 and 2. The compressible portion 322 of the second connecting part 32 of the fastener 3 can be previously arranged in the guide-groove space 10. The elastomer 34 at two ends of the compressible portion 322 can be compressed to be elastically deformed such that the two ends, i.e. elastomer 34, of the compressible portion 322 of the fastener 3 can abut against sidewalls of the guide-groove space 10 formed by the first and second frames 1 and 2 such that the guide-groove space 10 formed by the first and second frames 1 and 2 can be pushed to expand and the joining portion 21 can be tightly secured to the joining groove 11, as shown in FIGS. 4 and 6. Thereby, the first and second frames 1 and 2 can firmly join. The first connecting part 31 of the fastener 3 can be bent into the guide-groove space 10. The ⊓-shaped elastic element 33 can serve as a stop mechanism to stop the first connecting part 31 freely dropping from the guide-groove space 10, as shown in FIG. 7.

When the guide-groove space 10 formed by the first and second frames 1 and 2 is pushed to expand, the clipping space 20 formed by the first and second frames 1 and 2 is reduced to firmly clip a predetermined object 4, such as an advertising curtain, as shown in FIG. 4.

When the first and second frames 2 are being detached, the triggering portion 313 of the first connecting part 31 of the fastener 3 can be moved such that the first connecting part 31 can be moved from the guide-groove space 10 and then the compressible portion 322 of the second connecting part 32 of the fastener 3 can be released from the sidewalls of the guide-groove space 10 formed by the first and second frames 1 and 2. Thereby, the second connecting part 32 can be moved from the guide-groove space 10 and the joining portion 21 can be released from the joining groove 11. Accordingly, the first and second frames 1 and 2 can be quickly assembled and disassembled.

When the compressible portion 322 of the second connecting part 32 of the fastener 3 is arranged in the guide-groove space 10, the blocking of the bump 323 can lead the fastener 3 to bend in only one direction. Accordingly, a foolproof way for the assembly or disassembly can be achieved. The slopped surface 3131 of the triggering portion 313 of the fastener 3 can be ensured to get far away from a surface of the guide-groove space 10. Thereby, a user can easily move or lift the triggering portion 313, as shown in FIG. 7.

Figure 8:
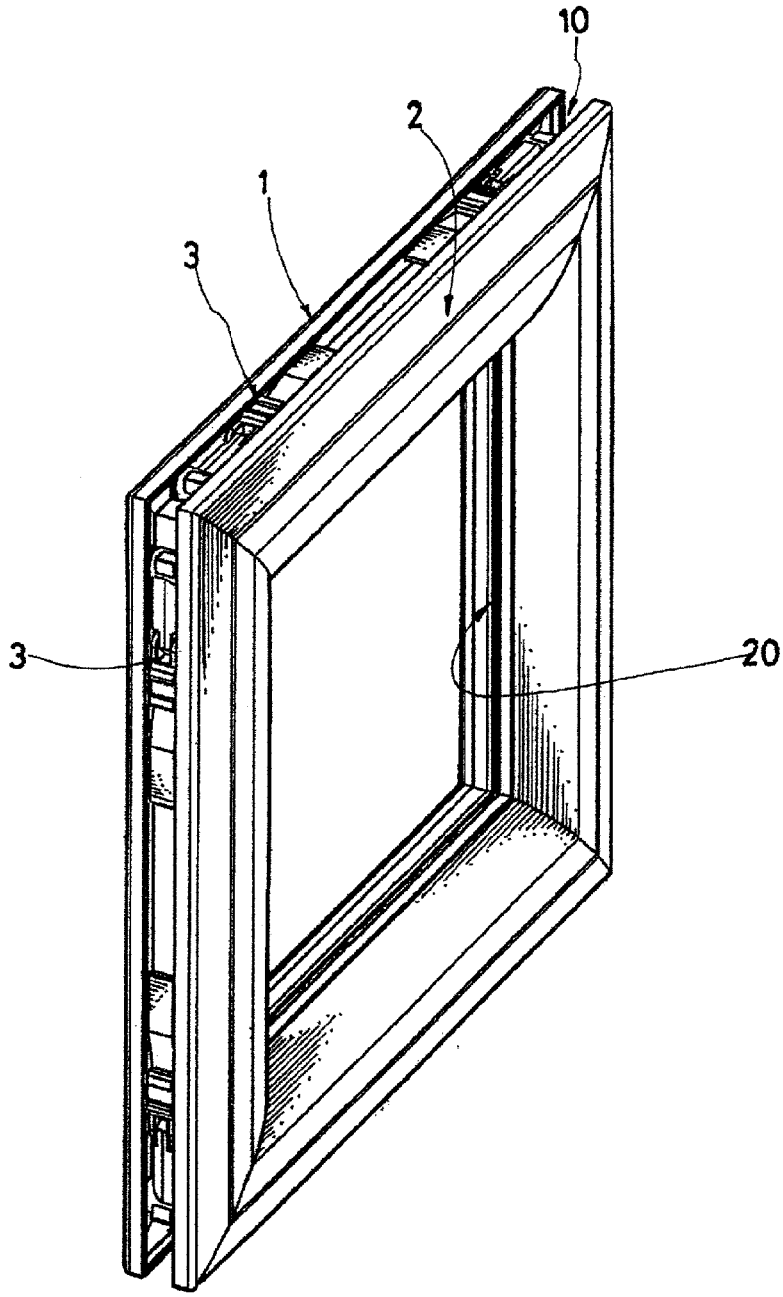
FIG. 8 is a schematic view of the structure for quickly clipping the advertising curtain in accordance with an embodiment of the present invention.

Referring to FIG. 8, the connecting groove 14 at the first frame 1 can be connected with an external predetermined connecting device or on-wall connecting device. Each section of the first and second frames 1 and 2 has a length that can be decided and the connection of the lengths can also be decided. The first frame 1 can be connected with another first frame 1 or more than one other first frames 1. In an embodiment, the first frames 1 can be connected with one another so as to form a square-shaped frame.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain. Furthermore, unless stated otherwise, the numerical ranges provided are intended to be inclusive of the stated lower and upper values. Moreover, unless stated otherwise, all material selections and numerical values are representative of preferred embodiments and other ranges and/or materials may be used.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. A structure for quickly clipping an advertising curtain, comprising:

a first frame provided with a joining groove at a side of the first frame, a first guide groove at a side of the joining groove and a first recessed groove at another side of the joining groove;

a second frame secured to the first frame, wherein the second frame comprises a joining portion at a side of the second frame, wherein the joining portion is configured to be secured to the joining groove at the first frame, wherein the joining portion is provided with a second guide groove at a side of the joining portion and a second recessed groove at another side of the joining portion, wherein the first and second guide grooves form a guide-groove space, wherein the first and second recessed grooves form a clipping space; and at least a fastener arranged in the guide-groove space formed by the first and second frames, wherein the fastener comprises a first connecting part comprising a first connecting portion at an end of the first connecting part, a triggering portion at another end of the first connecting part and a ⊓-shaped elastic element between the first connecting portion and the triggering portion, and a second connecting part comprising a second connecting portion at an end of the second connecting part and a compressible portion at another end of the second connecting part, wherein the second connecting portion is pivoted with the first connecting portion of the first connecting part, wherein the compressible portion extends from two sides of the second connecting part, wherein the compressible portion comprises elastomer, at two ends of the compressible portion, configured to be compressed by sidewalls of the first and second guide grooves.

2. The structure of claim 1, wherein at least a first locking hook is arranged at an open end of the joining groove, wherein the joining portion comprises at least a second locking hook configured to be engaged with the first locking hook.

3. The structure of claim 1, wherein at least a connecting groove is arranged at another side of the first frame.

4. The structure of claim 1, wherein the compressible portion and the second connecting part construct a T-shaped structure.

5. The structure of claim 1, wherein the triggering portion has a slopped surface facing the guide-groove space.

6. The structure of claim 1, wherein the compressible portion comprises at least a bump, protruding from the compressible portion, far away from a surface of the guide-groove space.

7. The structure of claim 1, wherein the first connecting part is provided with a securing groove between the first connecting portion and the triggering portion, wherein the ⊓-shaped elastic element is fixed with the securing groove.

8. The structure of claim 1, wherein the clipping space is configured to clip a predetermined object.

* * * * *